US006340936B1

(12) United States Patent
McGaffey et al.

(10) Patent No.: US 6,340,936 B1
(45) Date of Patent: Jan. 22, 2002

(54) ACCESSIBLE PEDESTRIAN SIGNAL SYSTEM

(76) Inventors: John F. McGaffey, 36865 Avenida La Cresta, Murrieta, CA (US) 92563; Wayne L. Russell, 2503 Raymond Pl., Ontario, CA (US) 91761; Randy Van Cruz, 701 Rye Ave., La Habra, CA (US) 90631; Leslie A. Beckwith, 12778 Stanhill Dr., La Mirada, CA (US) 90638

( * ) Notice: Subject to any disclaimer, the term of this patent is extended or adjusted under 35 U.S.C. 154(b) by 0 days.

(21) Appl. No.: 09/640,581

(22) Filed: Aug. 18, 2000

(51) Int. Cl.[7] ..... G08G 1/095
(52) U.S. Cl. ..... 340/944; 340/407.1
(58) Field of Search ..... 340/944, 925, 340/929, 407.1, 388.1, 825.46, 384.1

(56) References Cited

U.S. PATENT DOCUMENTS 2,461,448 A * 2/1949 Smith ..... 340/944
4,187,418 A * 2/1980 Harris ..... 340/944
4,590,474 A 5/1986 Patterson et al.
4,851,836 A * 7/1989 Wilkinson et al. ..... 340/944
5,103,223 A * 4/1992 Humphrey ..... 340/944
5,172,092 A * 12/1992 Nguyen et al. ..... 340/407.1
5,241,307 A * 8/1993 Bidault et al. ..... 340/944
5,519,390 A * 5/1996 Casini ..... 340/944

* cited by examiner

*Primary Examiner*—John Tweel, Jr.
(74) *Attorney, Agent, or Firm*—Edgar W. Averill, Jr.

(57) ABSTRACT

An accessible pedestrian signal system to assist visually impaired persons to cross a signal controlled intersection. The signal system has a push button which is pressed by the pedestrian. Circuitry is provided to vibrate the push button when the signal system is programmed to send a signal that it is time to cross the intersection. Preferably, the push button is mounted on a flexible diaphragm and a vibrating movement is transmitted to the inner surface of the diaphragm when it is desired to vibrate the push button. Preferably, the pressing of the button flexes a piezo-electric member which has an output to the circuitry of the signal system.

15 Claims, 3 Drawing Sheets

ACCESSIBLE PEDESTRIAN SIGNAL SYSTEM

BACKGROUND OF THE INVENTION

The field of the invention is pedestrian signal indicators and the invention relates more particularly to pedestrian signal indicators which are provided with a tactile output so that a person of limited vision can determine when it is time to cross the signal controlled intersection.

The most metropolitan areas in the United States have intersections controlled by traffic lights. These intersections are also equipped with walk/don't walk signals to make it safe for pedestrians to cross the street. Such walk/don't walk signals are invariably equipped to provide a visual walk/don't walk signal. For persons of limited vision, such lighted signals are often of no value. For this reason various pedestrian signal systems have been developed which provide an audible or tactile signal that persons of impaired vision can use.

One such system is shown in U.S. Pat. No. 2,461,448. A button 14 either projects or is flush with the casing, depending on whether the traffic lights are red or green. This provides a tactile indication to a blind person as to whether the light is red or green. Two alternate versions show a pair of push buttons so that a blind person feeling for a signal can always obtain a positive indication and avoid the danger of feeling the top of the casing and assuming that the button is depressed, whereas he may not be feeling the correct spot. A third version causes the button to extend if the power goes out, thereby indicating an unsafe condition. An audible buzzer is also shown.

U.S. Pat. No. 4,590,474 shows a street crossing signal which includes a pair of handrails which are oriented in the direction of the crossing so that the blind person can orient himself in a desired direction for crossing the street. A vibrator is included in the handrail so, when the lights at the crosswalk are in a designation inviting pedestrian crossing, the vibration means in the handrail is activated.

In U.S. Pat. No. 4,851,836, the pedestrian crossing system includes a tactile tone generator. The tone is generated in an area located immediately above the push button switch. U.S. Pat. No. 5,103,223 utilizes a street crossing signal which includes means for vibrating a direction arrow extending through the panel 23. The depressing of a push button 24 initiates the crossing signal sequence.

While the above-described systems assist a visually impaired pedestrian, further simplification, which makes it easier for the pedestrian to become informed when the walk indicator is active, is needed.

BRIEF SUMMARY OF THE INVENTION

It is the object of the present invention to provide an accessible signal system to assist visually impaired persons to cross a signal controlled intersection which system is intuitively simple to use and highly reliable and provides information currently not provided by other devices on the market.

The present invention is for an accessible pedestrian signal system which includes a push button station, which includes means for generating a tactile signal and also audible information. The system has a push button frame mounted at or near each crosswalk at the intersection. A flexible diaphragm is mounted on the frame and supports a push button which is used to initiate a pedestrian crossing signaling sequence. Means are provided for vibrating the push button so that a pedestrian may receive a tactile response while touching the push button to convey a cross/don't cross indication. Preferably, the pressing of the push button flexes a piezo-electric switch to transmit a signal to the control circuit for the intersection. Also preferably, a coil causes a plunger to vibrate and the movement of the plunger is transmitted to the push button. Also preferably, the push button is mounted on a flexible diaphragm over an opening in the frame. The diaphragm allows limited movement of the button and a backing plate holds the diaphragm and the button together. The backing plate is designed to contact the frame as a hand stop when the button is impacted, thus protecting the internal mechanism of the device. The use of the diaphragm and the limited movement provides a push button assembly with a high degree of vandal resistance yet allows the button to both move and vibrate to indicate a walk cycle.

DESCRIPTION OF THE PREFERRED EMBODIMENTS

Figure 1:
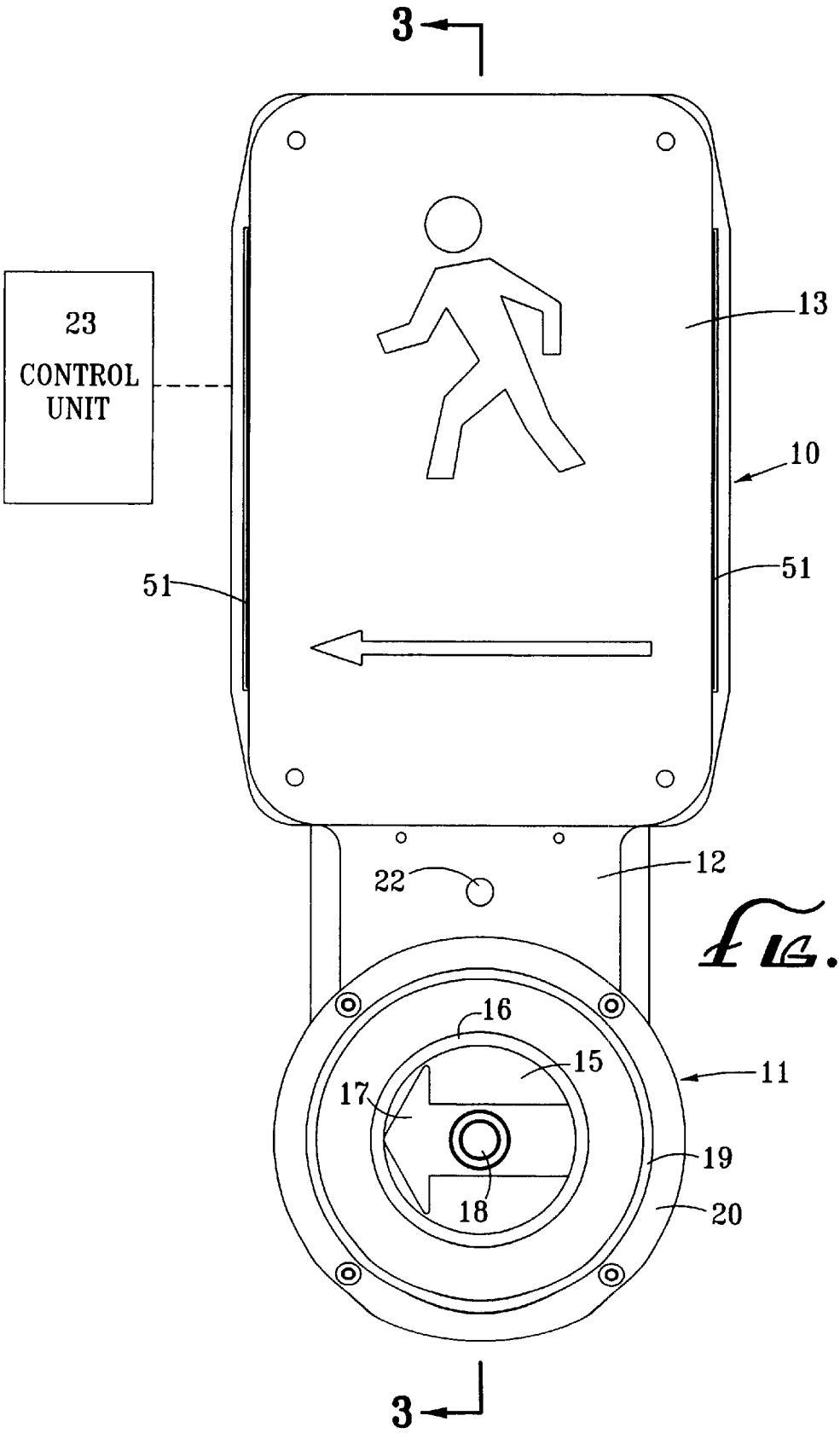
FIG. 1 is a front view of the accessible pedestrian signal system of the present invention.

The accessible pedestrian signal system of the present invention is shown in front view in FIG. 1 and indicated generally by reference character 10. The system has a push button station indicated generally by reference character 11 which is mounted on a push button frame 12. A pedestrian sign or panel 13 provides notice that the intersection is controlled by a pedestrian crossing signal system. Panel 13 also provides a protective cover for an outdoor speaker 14 shown in FIG. 2. Speaker 14 can provide a locating tone as well as audible information about the intersection as well as the status of the walk or don't walk signals.

Figure 2:
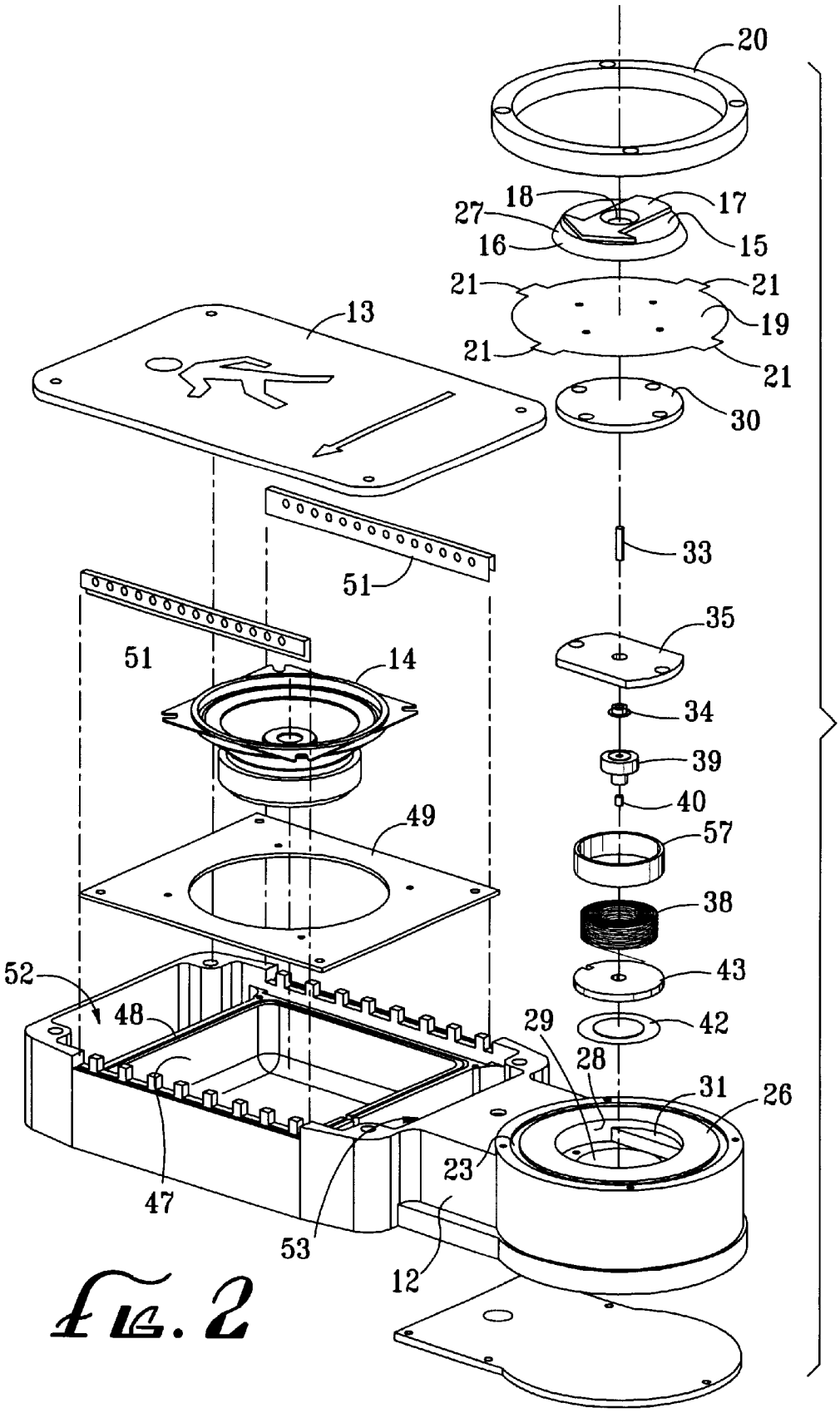
FIG. 2 is an exploded perspective view thereof.
Figure 3:
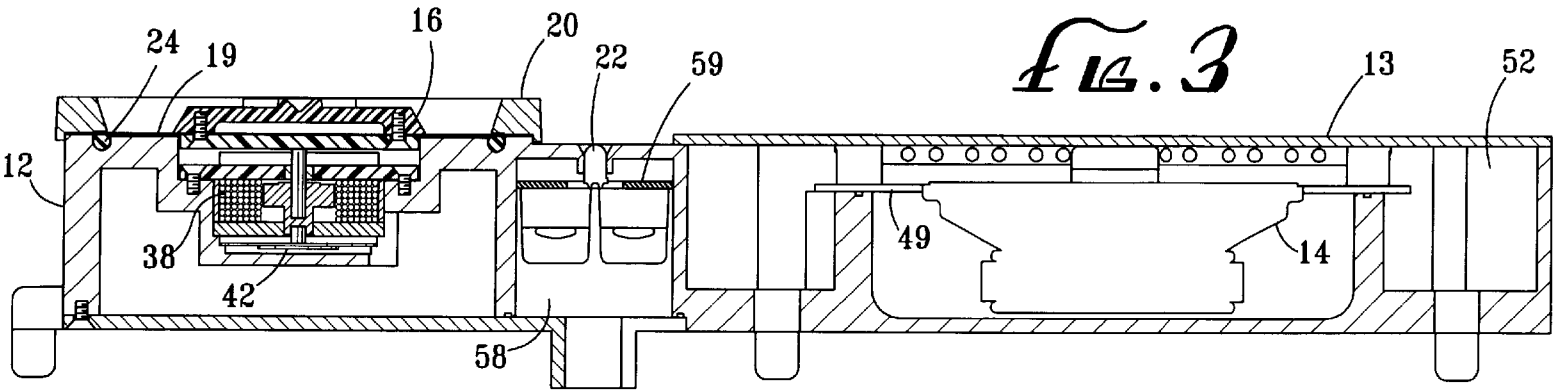
FIG. 3 is a cross-sectional view thereof.

Accessible pedestrian signal system 10 includes a push button 15 which is a circular aluminum piece with a chamfered edge 16 and a raised arrow 17. A central depression 18 assists the user to hold his finger in the middle of the push button 15 to await a tactile signal. Push button 15 is mounted on a flexible diaphragm 19. An aluminum ring 20 holds the flexible diaphragm 19 and, thus, the push button 15 to frame 12. Flexible lot diaphragm 19 is shown in FIG. 2 and can be seen to have four tabs 21 which permit the push button 15 to be oriented in four different positions, depending upon the location of the crosswalk. Flexible diaphragm 19 is preferably fabricated from stainless steel having a thickness of about 0.008 inches. This provides a combination of flexibility and strength which permits the easy pushing of push button 15, while still providing the vandal resistant closure to the components in opening 29. The provision of various steps in opening 29 provide an especially durable land maintenance-free assembly.

Once push button 15 is depressed, indicator light 22 turns on to inform the non-visually impaired pedestrian that the button has been pushed. A control unit 23 is diagrammatically indicated and is electronically connected to the accessible pedestrian signal system 10 in a conventional manner. Once push button 15 is depressed and the presence of a pedestrian call is signaled to control unit 23, the control unit can initiate a voice-on-location option. The control unit can provide that if the push button 15 is held for an extended period of time, such as at least about three seconds, a message will play announcing the intersection and the street being crossed. In this way, a person with impaired vision can be assured that he or she is in the correct location. Also, by delaying the initiation of the message for three seconds or longer, the message announcing location will not be aimlessly repeated. The system 10 can also include a locating tone to assist a blind person to find the push button. The control unit can provide various jumper settings for different verbal messages or walk sounds. The unit is preferably equipped with means for raising the volume of the audible sounds, depending upon traffic noise. The message process operates by inputting information in electronic circuitry capable of emitting an audible output in the pedestrian signal system. The audible output includes announcement of the particular intersection at which the pedestrian signal system is located.

When the push button is pressed it will provide a timed output. A timing circuit is provided to detect the presence of said timed output and the timing circuit. A signal is transmitted to said electronic circuitry capable of emitting an audible output in the pedestrian signal system providing the announcement of the particular intersection at which the pedestrian signal system is located when said push button is depressed for at least about three seconds. The timing circuit does not provide an announcement when the push button is depressed for less than about three seconds.

Once push button 15 has been depressed, the walk/don't walk information cycle is initiated. A visually impaired person would maintain his finger on push button 15 and when the "walk" time has arrived, the push button 15 will vibrate, telling the pedestrian that the walk signal is on. The details of how this vibration is accomplished are set forth below.

Figure 4:
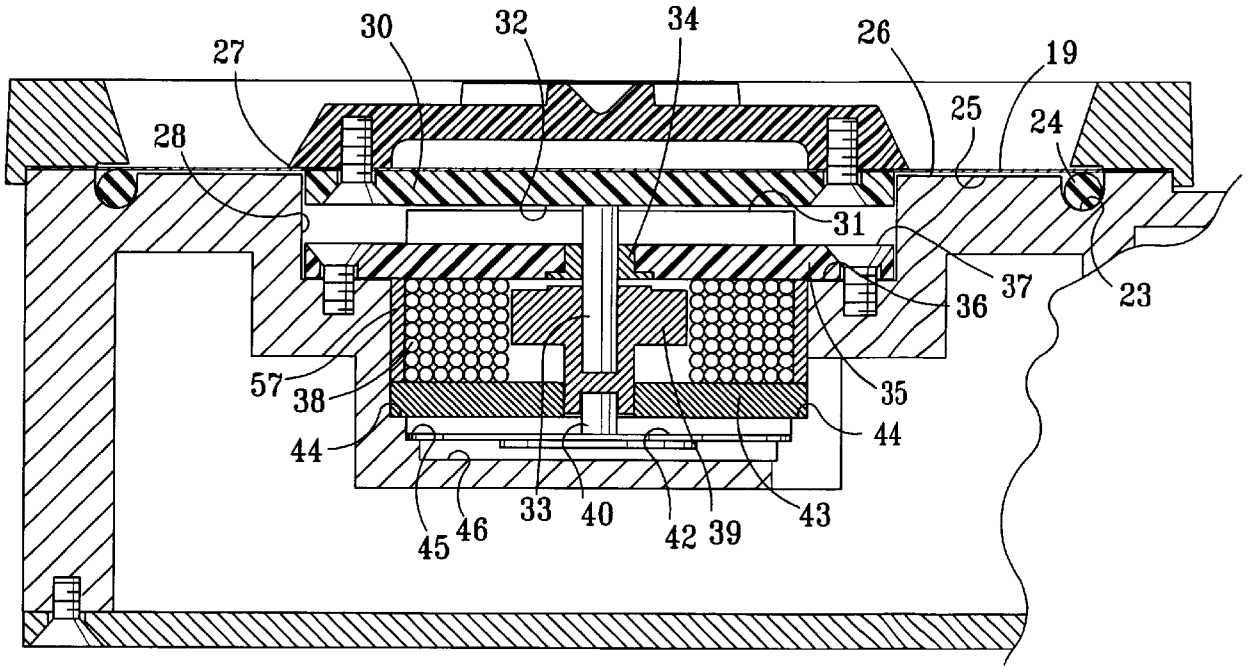
FIG. 4 is an enlarged cross-sectional view of the push button portion of the system of FIG. 1.

The individual parts used in accessible pedestrian signal system 10 are shown in exploded perspective view in FIG. 2. Frame 12 has a circular push button portion which includes a circular groove 23 which holds an o-ring 24 shown in FIG. 4. O-ring 24 serves the following functions. First, it rests against the inwardly facing surface 25 of flexible diaphragm 19 and provides a water-proof intersection between the diaphragm and the frame 12. Also, as shown best in FIG. 4, it raises the flexible diaphragm 19 above support surface 26. Thus, when push button 15 is depressed, flexible diaphragm 19 moves inwardly slightly as viewed in FIG. 4, but the inward movement is limited by the contact between a rigid (e.g. Nylon or aluminum) back plate 30 held against undersurface 25 of flexible diaphragm 19 which bottoms onto the upper surface of floor 31. Preferably, the outer peripheral edge 27 of push button 15 extends past the edge 28 of opening or recess 29 for strength and vandal protection. As shown best in FIG. 4, back plate 30 is held by screws through diaphragm 19 to push button 15. Back plate 30 has an outwardly facing surface which contacts the inwardly facing surface 25 of diaphragm 19. Back plate 30 also has an inwardly facing surface 32. Inwardly facing surface 32 is contacted by a vibration transmitting pin 33. Pin 33 is guided by bushing 34 supported in guide plate 35. Guide plate 35 is secured on step 36 by screws 37. Back plate 30 is preferably fabricated from machined aluminum that is hard nickel plated or hard anodized. Alternately, it may be fabricated from Nylon or other impact resistant polymer. With this construction it is almost completely impervious to damage by impact.

The push button 15 is caused to vibrate by a solenoid. The solenoid consists of a coil 38, and a steel enclosure consisting of a steel top plate 35, a steel ring 57, and a steel bottom plate 43. The coil is positioned inside the steel enclosure. The coil surrounds a ferro-magnetic vibrating member 39. The solenoid assembly rests on step 44 (FIG. 4) of inside opening 29. The steel enclosure around the coil forms an efficient magnetic path for the field produced by the coil which, when energized, causes the vibrating member 39 to move.

Pin 33 is adhered to vibrating member 39 so that it moves with vibrating member 39 and transmits the vibration to the inwardly facing side of back plate 30 and, thus, to push button 15. Vibrating member 39 also has a second recess to which rubber pin 40 is adhered. Rubber pin 40 transmits the depressed movement of push button 15 to piezo-electric element 42. The piezo-electric element 42 is connected via two wires to the switch circuit on OCB assembly 59 located in cavity 58 on frame 12. Two 5 position terminal blocks on PCB assembly 59 facilitate connections via eight wires to control unit 23 to initiate the various functions involved in the operation of the signal. The control unit 23 can be located either in the pedestrian signal corresponding to the push button station, or in the intersection control cabinet. Piezo-electric element 42 rests on step 45 which is just above the bottom 46 of opening 29. This base provides sufficient room for the slight deflexion of piezo-electric element 42.

Returning to FIG. 2, it can also be seen that frame 12 includes a speaker recess 47. A wall has an upper surface 48 which supports speaker mounting plate 49. Speaker 14 is screwed into the tapped holes in plate 49.

A pair of U-shaped perforated stainless steel covers are looped over squared posts 51 and help protect the speaker against vandalism while still permitting sound to traverse the covers. An upper compartment 52 and lower compartment 53 provide access to mounting holes in frame 12 for mounting the unit to a pole or surface. Compartment 53 also provides for wires to route from the speaker to terminal blocks on switch circuit PCB assembly 59 located in cavity 58.

The frame is preferably cast from aluminum and the front panel 13 and the back panel 54 are secured to the frame by vandal-resistant fasteners.

While a piezo-electric element has been shown and is the preferred method of initiating a signal, other switch means can, of course, be used. Because of the presence of a speaker, numerous audible instructions and information can be heard from the unit. The combination of the activating push button with the tactile vibration simplifies the construction and permits a compact and attractive unit.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

We claim:

1. An accessible pedestrian signal system to assist visually impaired persons to cross a signal-controlled intersection, said signal system being of the type including a push button station including a tactile signal generated in the push button station, wherein the improvement comprises:

a push button frame including means for mounting the frame on a support structure located at the signal-controlled intersection;

a flexible diaphragm mounted on said frame, said flexible diaphragm having an inwardly facing surface and an outwardly facing surface;

a push button mounted on said outwardly facing surface, said push button having an outwardly-facing, finger-contacting surface; and means for vibrating the push button so that a pedestrian may receive a tactile response while touching the push button to convey a cross/don't-cross indication.

2. The accessible pedestrian signal system of claim 1 wherein said means for vibrating said push button comprises a vibrating member having a contact surface the movement of which is physically transmitted to said diaphragm.

3. The accessible pedestrian signal system of claim 2 further including a back plate affixed against said inwardly facing surface of said diaphragm and said vibrating member touches said back plate.

4. The accessible pedestrian signal system of claim 3 wherein said back plate and said push button sandwiches said diaphragm between them.

5. The accessible pedestrian signal system of claim 4 wherein back plate has an outwardly facing surface facing said diaphragm and an inwardly facing surface including a frame-stop contact surface.

6. The accessible pedestrian signal system of claim 5 wherein said frame includes a back plate recess including a back plate stop for limiting the inward movement of the back plate and thus limiting the inward movement of the diaphragm and the push button.

7. The accessible pedestrian signal system of claim 6 wherein the pushing in of said push button transmits a pushing in deflection of a piezo-electric element.

8. The accessible pedestrian signal system of claim 1 wherein said diaphragm is shaped to be fitted in said frame in four possible orientations, each orientation being ninety degrees from an adjacent orientation.

9. The accessible pedestrian signal system of claim 8 wherein said diaphragm is a thin plate supported to said frame near an outer peripheral edge of said diaphragm.

10. The accessible pedestrian signal system of claim 9 wherein said outer peripheral edge of said diaphragm has four protrusions extending outwardly therefrom.

11. The accessible pedestrian signal system of claim 9 wherein said thin plate is fabricated from stainless steel.

12. An accessible pedestrian signal system to assist visually impaired persons to cross a signal-controlled intersection, said signal system being of the type including a push button station including a tactile signal generated in the push button station, wherein the improvement comprises:

a push button frame including means for mounting said frame on a support structure located at the signal-controlled intersection;

a push button mounted on a flexible member supported by said frame which permits limited axial movement of said push button with respect to said frame; and a solenoid assembly supported by said frame inwardly with respect to said push button, said solenoid assembly including a plunger surrounded by a coil, said plunger supporting a motion transmitting pin having a button assembly contacting surface positioned to transmit the motion of the plunger to the push button.

13. The accessible pedestrian signal system of claim 12 further including a piezo electric element positioned inwardly from said plunger and said plunger including a contact foot which is positioned to contact and deflect said piezo-electric element when said push button is pushed.

14. The accessible pedestrian signal system of claim 13 wherein said contact foot is fabricated from an elastomer.

15. A pedestrian signal system to assist persons to cross a signal-controlled intersection, said signal system being of the type including a push button station, wherein the improvement comprises:

a push button frame including means for mounting the frame on a support structure located at the signal-controlled intersection;

a flexible diaphragm mounted on said frame, said flexible diaphragm having an inwardly facing surface and an outwardly facing surface and said flexible diaphragm being mounted over an opening in said frame, said opening extending below a support surface at an opening edge and said flexible diaphragm extending beyond said opening edge and said flexible diaphragm being spaced above said support surface of said frame; and a push button mounted on said outwardly facing surface, said push button having an outwardly-facing, finger-contacting surface and an inwardly facing surface mounted against said outwardly facing surface of said flexible diaphragm and a back plate is held against the inwardly facing surface of said flexible diaphragm and a floor is positioned and held by said frame to abut said back plate and limit the inward movement of said back plate and said push button.

* * * * *